US006391466B1

(12) United States Patent
Sogabe et al.

(10) Patent No.: US 6,391,466 B1
(45) Date of Patent: May 21, 2002

(54) THERMAL TRANSFER RECORDING MEDIUM

(75) Inventors: Jun Sogabe; Tetuo Hoshino; Kotaro Fujimoto, all of Osaka; Yoshiyuki Asabe; Susumu Arauchi, both of Tokyo-to, all of (JP)

(73) Assignee: Fujicopian Co., Ltd., Osaka (JP)

( * ) Notice: Subject to any disclaimer, the term of this patent is extended or adjusted under 35 U.S.C. 154(b) by 0 days.

(21) Appl. No.: 09/516,421

(22) Filed: Mar. 1, 2000

(30) Foreign Application Priority Data

Mar. 2, 1999 (JP) ..... 11-054434

(51) Int. Cl.[7] ..... B41M 5/26

(52) U.S. Cl. ..... 428/484; 428/195; 428/913; 428/914

(58) Field of Search ..... 428/195, 484, 428/488.1, 488.4, 913, 914

(56) References Cited

U.S. PATENT DOCUMENTS

| | | | | |
|---|---|---|---|---|
| 5,053,267 | A | 10/1991 | Ide | 428/195 |
| 5,362,548 | A | 11/1994 | Hiyoshi | 428/195 |
| 5,605,766 | A | 2/1997 | Arimura | 428/488.4 |
| 5,843,563 | A | 12/1998 | Tuyuguchi | 428/212 |

FOREIGN PATENT DOCUMENTS

| | | | |
|---|---|---|---|
| EP | 0 510 661 | A1 | 10/1992 |
| EP | 0 658 444 | A1 | 12/1994 |
| JP | 59209196 | A | 11/1984 |
| JP | 1281992 | A | 11/1989 |
| JP | 10329435 | A | 12/1998 |

*Primary Examiner*—Bruce H. Hess
(74) *Attorney, Agent, or Firm*—Fish & Neave

(57) ABSTRACT

A thermal transfer recording medium comprising a support, and at least a heat-meltable release layer and a colored ink layer capable of being softened with heat stacked in this order on the support, the release layer comprising a wax as a main ingredient, and the release layer having a melting point of not less than 85° C., a heat of fusion of not more than 140 mJ/mg, and a melt viscosity of not more than 50 cps/120° C.

2 Claims, No Drawings

THERMAL TRANSFER RECORDING MEDIUM

BACKGROUND OF THE INVENTION

The present invention relates to a thermal transfer recording medium useful for forming an image of high quality, particularly a multi-gradation color image of high quality even on a paper sheet having a low surface smoothness (hereinafter referred to as "rough paper sheet").

Conventionally used thermal transfer recording media capable of forming images on a rough paper sheet include one wherein a release layer containing a wax as a main ingredient is provided on a support and a colored ink layer capable of being thermally softened is provided on the release layer.

On the other hand, as one of means for obtaining a multi-gradation color image of high quality, there is a method using a so-called "variable dot type thermal head" wherein the heat-generation area of each heating resistor element of a thermal head is variable by adjusting the energy applied to the heating resistor element. In order to aim at the formation of multi-gradation color images of high quality using such a variable dot type thermal head according to an area gradation method, it is necessary to improve the transferability of a thermal transfer ink at a small area. Heretofore the improvement of such a transferability has been effected by lowering the softening point of a colored ink layer and/or a release layer.

However, this method causes collapsed ink dots in high density region, resulting in failure to obtain multi-gradation color images of high quality over a wide gradation range.

It is an object of the present invention to provide a thermal transfer recording medium capable of forming an image of high quality, particularly a multi-color gradation image of high quality even on a rough paper sheet by means of a thermal transfer mechanism, particularly an area gradation method using a variable dot type thermal head.

This and other objects of the present invention will become apparent from the description hereinafter.

SUMMARY OF THE INVENTION

The invention set forth in claim 1 provides a thermal transfer recording medium comprising a support, and at least a heat-meltable release layer and a colored ink layer capable of being softened with heat stacked in this order on the support, the release layer comprising a wax as a main ingredient, and the release layer having a melting point of not less than 85° C., a heat of fusion of not more than 140 mJ/mg, and a melt viscosity of not more than 50 cps/120° C.

The invention set forth in claim 2 provides the thermal transfer recording medium of claim 1, wherein the wax as a main ingredient in the release layer comprises a modified wax grafted with maleic anhydride.

DETAILED DESCRIPTION

In accordance with the present invention, there is provided a thermal transfer recording medium comprising a support, and at least a heat-meltable release layer and a colored ink layer capable of being softened with heat stacked in this order on the support, characterized in that the release layer comprises a wax as a main ingredient, and that the release layer has a melting point of not less than 85° C., a heat of fusion of not more than 140 mJ/mg, and a melt viscosity of not more than 50 cps/120° C. It has been discovered that by virtue of such features, the thermal transfer recording medium of the present invention is able to form an image of high quality, particularly a multi-gradation image of high quality even on a rough paper sheet by using a variable dot type thermal head according to an area gradation method.

When the melting point of the release layer is lower than 85° C., collapsed ink dots are liable to occur in high density region. The melting point of the release layer is preferably not less than 90° C. in order to prevent occurrence of collapsed ink dots more sufficiently. When the melting point of the release layer is more than 120° C., the transfer sensitivity is markedly lowered. Therefore, the melting point of the release layer is preferably not more than 120° C. However, increasing simply the melting point of the release layer to a temperature within the above-mentioned range does not lead to an improvement in image quality because the transferability in low density region is degraded. It has been discovered that this problem can be solved by setting the heat of fusion of the release layer to 140 mJ/mg or less. Further, it is necessary that the melt viscosity of the release layer is not more than 50 cps/120° C. in order to retain a favorable transferability to a rough paper sheet.

As the support usable in the present invention, various materials used as the support for conventional thermal transfer recording media can be employed. Polyester films, especially polyethylene terephthalate film, having a thickness of 2 to 6 $\mu$m are preferable from the viewpoints of their durability, heat conduction and cost. It is preferable to provide a release treatment (anti-sticking layer) on the back side of the support.

The release layer which is characteristic of the present invention comprises a wax as a main ingredient. One or more waxes are selectively used so that the resulting release layer has a melting point of not less than 85° C., a heat of fusion of not more than 140 mJ/mg, and a melt viscosity of not more than 50 cps/120° C.

Preferable examples of waxes used as a main ingredient are waxes selected among modified carnauba wax, oxidized polyethylene wax, oxidized microwax, modified waxes grafted with maleic anhydride, and the like, and which have a melting point of not less than 85° C., a heat of fusion of not more than 140 mJ/mg, and a melt viscosity of not more than 50 cps/120° C. Modified waxes grafted with maleic anhydride include those wherein a wax such as polyethylene wax, paraffin wax or the like is modified by grafting maleic anhydride onto the wax. All of these modified waxes do not meet the physical properties prescribed above and most modified waxes rather have physical properties outside the values prescribed above. For example, the melt viscosity of a modified wax increases with increasing degree of modification and cannot be retained within the prescribed value of melt viscosity, i.e. not more than 50 cps/120° C. Therefore, it is desirable to select modified waxes satisfying the prescribed values of physical properties by fully taking the kind of modified waxes, degree of modification, modifying method, and the like into consideration.

Waxes, such as carnauba wax, polyethylene wax and paraffin wax, which are commonly used for thermal transfer recording media, cannot be used as a main wax for the release layer in the present invention due to their drawbacks mentioned below. Carnauba wax or paraffin wax hardly exhibits the desired effect of the present invention because of their low melting points. There are some of polyethylene waxes and paraffin waxes which have a high melting point and a low melt viscosity. However, they degrade a transferability in low density region due to their large heat of fusion.

Generally polyethylene waxes degrade an overall transferability due to their high melt viscosity.

However, these usual waxes, the physical values of which are outside the prescribed values, may be used as far as the object of the present invention is not injured. Further, as required, the release layer may be incorporated with a thermoplastic resin. Examples of the thermoplastic resins include olefin copolymers such as ethylene-vinyl acetate copolymer, polyamide resins, polyester resins, natural rubber, petroleum resins, rosin resins, styrene resins, and the like. The amount of the thermoplastic resin added is preferably not more than 10% by weight, more preferably not more than 5% by weight, based on the total amount of the release layer.

The thickness of the release layer is preferably from 0.1 to 2.0 μm from the viewpoint of adaptation for thermal transfer. When the thickness of the release layer is less than 0.1 μm, the release performance cannot be secured. When the thickness of the release layer is more than 2.0 μm, a large amount of heat is needed to melt the release layer, resulting in poor transferability.

The colored ink layer capable of being thermally softened usable in the present invention comprises a coloring agent and a binder. In order to impart a so-called "bridging transfer performance" against rough paper sheet to the colored ink layer, the binder preferably comprises a thermoplastic resin as a main ingredient thereof so that the colored ink layer is softened but not completely melted when transferring. The bridging transfer performance means that the ink layer can be transferred as bridging over depressed portions of a rough paper sheet with being adhered to only protruding portions thereof. Examples of the thermoplastic resins include olefin copolymers such as ethylene-vinyl acetate copolymer, polyamide resins, polyester resins, natural rubber, petroleum resins, rosin resins, styrene resins, and the like. These resins may be used either alone or in combination. As required, a wax may be added in order to adjust the melt viscosity of the ink layer. The ink layer may be further incorporated with a particulate material such as silica powder, or a lubricating agent such as silicone oil, fluorine-containing surface active agent or the like.

Coloring agents usable in the colored ink layer include various pigments and dyes. Examples of the pigments are azo pigments, phthalocyanine pigments, quinacridone pigments, thioindigo pigments, anthraquinoid pigments, isoindoline pigments, carbon black, and the like. These coloring agents may be used either alone or in combination.

The thickness of the colored ink layer is preferably from 0.5 to 3.0 μm from the viewpoints of adaptation for thermal transfer and bridging transfer performance against rough paper sheet.

The thermal transfer recording medium of the present invention can be used for forming multi-color or full-color images. The recording medium for such a use may have a structure wherein plural different color ink layers, for example, yellow ink layer, magenta ink layer and cyan ink layer, and optionally black ink layer are repeatedly provided in a side-by side relation on a single support, and another structure wherein respective color ink layers are provided on separate supports.

The present invention will be described in more detail by way of Example. It is to be understood that the present invention will not be limited to the Example, and various changes and modifications may be made in the invention without departing from the spirit and scope thereof. In the following Example and Comparative Examples, "parts" means parts by weight.

EXAMPLE

A polyethylene terephthalate film having a thickness of 2.5 μm provided on the back side thereof with a silicone resin based anti-sticking layer having a thickness of 0.2 μm was used as a support.

Coating Liquid A for Release Layer

| | |
|---|---|
| Maleic anhydride-grafted polyethylene wax (melting point: 97° C., heat of fusion: 120 mJ/mg, melt viscosity: 30 cps/120° C.) | 10 parts |
| Toluene | 90 parts |

The aforesaid coating liquid A was applied onto the opposite side of the support with respect to the anti-sticking layer and dried to form a release layer having a thickness of 1.0 μm.

Coating Liquid for Colored Ink Layer

| | |
|---|---|
| Ethylene-vinyl acetate copolymer (vinyl acetate content: 19% by weight; melt flow rate: 150) | 8 parts |
| Phthalocyanine blue | 2 parts |
| Toluene | 90 parts |

The aforesaid coating liquid was applied onto the release layer and dried to form an ink layer having a thickness of 2.0 μm, yielding a thermal transfer recording medium.

COMPARATIVE EXAMPLE 1

The same procedures as in the Example except that the below-mentioned coating liquid B was used instead of the coating liquid A for release layer to give a thermal transfer recording medium.

Coating Liquid B for Release layer

| | |
|---|---|
| Paraffin wax | 5 parts |
| Microwax | 5 parts |
| Toluene | 90 parts |

COMPARATIVE EXAMPLE 2

The same procedures as in the Example except that the below-mentioned coating liquid C was used instead of the coating liquid A for release layer to give a thermal transfer recording medium.

Coating Liquid C for Release Layer

| | |
|---|---|
| Modified paraffin wax | 10 parts |
| Toluene | 90 parts |

COMPARATIVE EXAMPLE 3

The same procedures as in the Example except that the below-mentioned coating liquid D was used instead of the coating liquid A for release layer to give a thermal transfer recording medium.

Coating Liquid D for Release Layer

| | |
|---|---|
| Modified paraffin wax | 5 parts |
| Oxidized polyethylene wax | 5 parts |
| Toluene | 90 parts |

The physical values of the release layers in the above-mentioned Example and Comparative Examples 1 to 3 are shown collectively in Table 1. The heat of fusion was measured with a differential scanning calorimeter, DSC-200 made by Seiko Instruments Inc. The melt viscosity was measured with a viscosity measuring apparatus available under the tradename "Soliquid meter MR-300" from Kabushiki Kaisha Reoroji.

Using each of the thermal transfer recording media obtained in the above-mentioned Example and Comparative Examples 1 to 3, printing is performed under the below-mentioned conditions to evaluate the gradation representation. The results are shown in Table 1.

Printing Conditions

Printer: MD 5000 (a variable dot printer made by Alps Electric Co., Ltd.)

Mode: Gray scale, VD photocolor mode

Printing paper: government postcard

Image data: portrait (ISO/DIS 12640 registered image data)

Evaluation Method

With respect to the obtained images, the smoothness of gradation was evaluated by the naked eye.

○: good

Δ: voids in low density region and collapsed dots in high density region occur. X: void-like appearance over the entire image.

TABLE 1

| | Melting point (° C.) | Heat of fusion (mJ/mg) | Melt viscosity (cps/120° C.) | Results | Remarks |
|---|---|---|---|---|---|
| Ex. | 97 | 120 | 30 | ○ | |
| Com. Ex. 1 | 75 | 140 | 40 | Δ | Note 1 |
| Com. Ex. 2 | 90 | 200 | 25 | Δ | Note 2 |
| Com. Ex. 3 | 95 | 105 | 100 | x | |

Note 1: collapsed dots in high density region
Note 2: voids in low density region In addition to the materials and ingredients used in the Example, other materials and ingredients can be used in the present invention as set forth in the specification to obtain substantially the same results.

As described above, when printing is conducted using the thermal transfer recording medium of the present invention on a variable dot printer, images of high quality, particularly multi-gradation color images of high quality can be formed even on a rough paper sheet.

What is claimed is:

1. A thermal transfer recording medium comprising a support, and at least a heat-meltable release layer and a colored ink layer capable of being softened with heat stacked in this order on the support, the release layer comprising a wax as a main ingredient, and the release layer having a melting point of not less than 85° C., a heat of fusion of not more than 140 mJ/mg, and a melt viscosity of not more than 50 cps/120° C.

2. The thermal transfer recording medium of claim 1, wherein the wax as a main ingredient in the release layer comprises a modified wax grafted with maleic anhydride.

* * * * *